United States Patent [19]

Ueno

[11] Patent Number: 4,843,204

[45] Date of Patent: Jun. 27, 1989

[54] MICROWAVE OVEN CAVITY HOUSING

[75] Inventor: Yoshiharu Ueno, Neyagawa, Japan

[73] Assignee: Sharp Kabushiki Kaisha, Osaka, Japan

[21] Appl. No.: 251,946

[22] Filed: Sep. 29, 1988

Related U.S. Application Data

[63] Continuation of Ser. No. 144,618, Jan. 11, 1988, abandoned, which is a continuation of Ser. No. 73,336, Jul. 13, 1987, abandoned, and a continuation of Ser. No. 811,725, Dec. 20, 1985, abandoned.

[51] Int. Cl.[4] ..... H05B 6/64; B21J 15/00

[52] U.S. Cl. ..... 219/10.55 R; 219/10.55 D; 219/391; 29/509; 126/273 R

[58] Field of Search ..... 219/10.55 R, 10.55 E, 219/10.55 D, 391; 126/273 R; 312/257 SM, 257 R, 236; 29/509, 522 R

[56] References Cited

U.S. PATENT DOCUMENTS

| | | | |
|---|---|---|---|
| 1,675,328 | 7/1928 | Borland | 29/509 |
| 3,602,980 | 9/1971 | Heffner | 29/509 |
| 3,688,385 | 9/1972 | Brown | 29/509 |
| 4,159,406 | 6/1979 | Tate et al. | 219/10.55 D X |
| 4,496,052 | 1/1985 | Nertman | 29/509 X |
| 4,609,801 | 9/1986 | Spencer et al. | 219/10.55 R |

*Primary Examiner*—Philip H. Leung

*Attorney, Agent, or Firm*—Flehr, Hohbach, Test, Albritton & Herbert

[57] ABSTRACT

An oven cavity housing for a microwave heating device, an electric toaster and the like consists of component plates which are joined together by tubular pieces provided on one of the plates to be joined together and inserted through holes in the other. These pieces have closed top ends, which are crushed so that no openings are left after the plates are joined and pieces of wire or the like will not pass through them to allow microwave energy to leak out.

4 Claims, 3 Drawing Sheets

MICROWAVE OVEN CAVITY HOUSING

This application is a continuation of Ser. No. 144, 618 filed Jan. 11, 1988 which is now abandoned and is a continuation of Ser. No. 073,336 filed July 13, 1987 which is now abandoned and is a continuation of Ser. No. 811,725 filed Dec. 20, 1985 which is now abandoned.

This invention relates to an oven cavity housing for a microwave heating device, an electric toaster and the like.

In general, the oven cavity housing of a microwave heating device and the like is constructed by assembling several components made of a plate-like material. Known for joining such plate-like materials are spot welding and methods of inserting protruding pieces through holes and bending or crushing their tops. The present invention relates to an improved method of the "eyelet hole caulking" type.

According to a conventional method of this type illustrated in FIG. 4, holes 22 are formed in one of the plates 21 and tubular protruding pieces 24 with an open end are provided on the other plate 23. The pieces 24 are inserted through the holes 22 and the plates 21 and 23 are joined together by spreading open the top part 25 of each piece 24 which protrudes to the other side as shown in FIGS. 4B and 4C. When plate-like components are joined in this manner, however, there usually remain openings 26 as shown in FIG. 4C where the joints are made. If an oven cavity housing is formed in this manner as schematically shown in FIG. 5 wherein numerals 31, 32 and 33 respectively indicate a back wall, a ceiling and a wave guide, a piece of wire or the like 35 may pass through such openings 26, causing microwaves to leak out therethrough.

It is therefore an object of the present invention in view of the possibilities of the kind illustrated above to provide a microwave oven cavity housing constructed by incorporating an improved method of making joints between plates.

The above and other objects of the present invention are attained by an improved method of joining components of an oven cavity housing. According to this method, holes are formed in one of the plates to be joined and tubular protruding pieces each with a closed end are provided on the other. These pieces are inserted into the correspondingly positioned holes and the protruding end sections are crushed to join the plates without leaving any openings where the protruding pieces pass through the holes.

The accompanying drawings, which are incorporated in and form a part of the specification, illustrate an embodiment of the present invention and, together with the description, serve to explain the principles of the invention.

Figure 1:
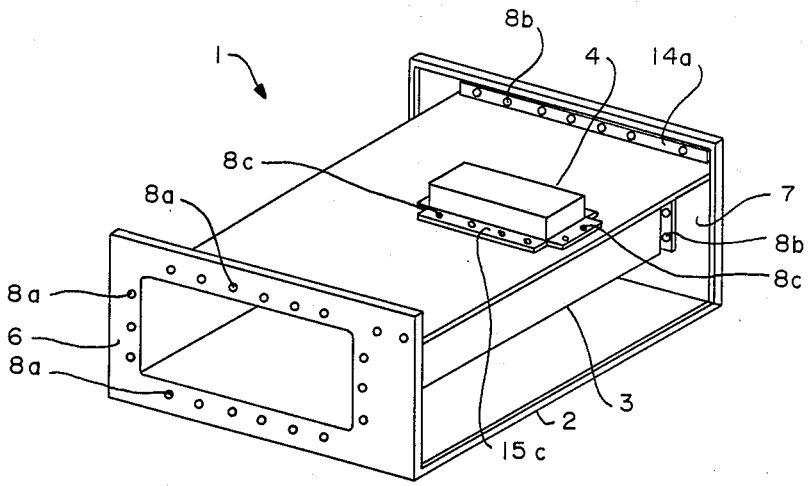
FIG. 1 is a diagonal view of an oven cavity housing embodying the present invention for a microwave heating device.
Figure 2A:
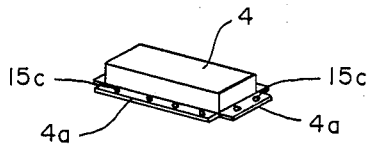
FIGS. 2A, 2B and 2C are diagonal views of individual components which comprise the housing of FIG. 1.
Figure 2B:
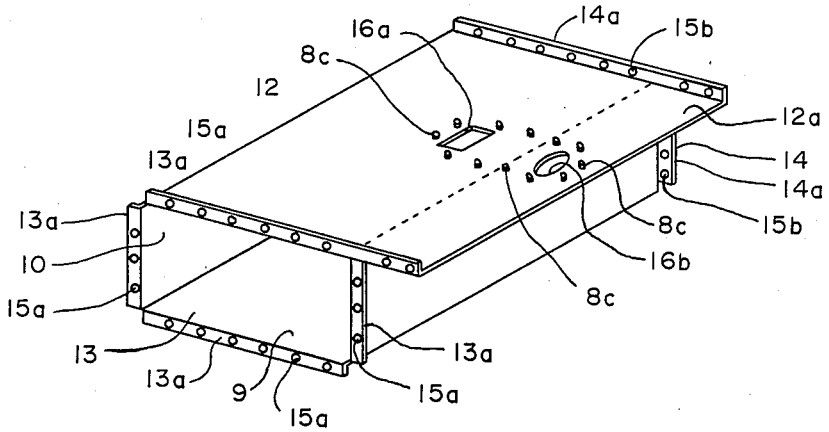
Figure 2C:
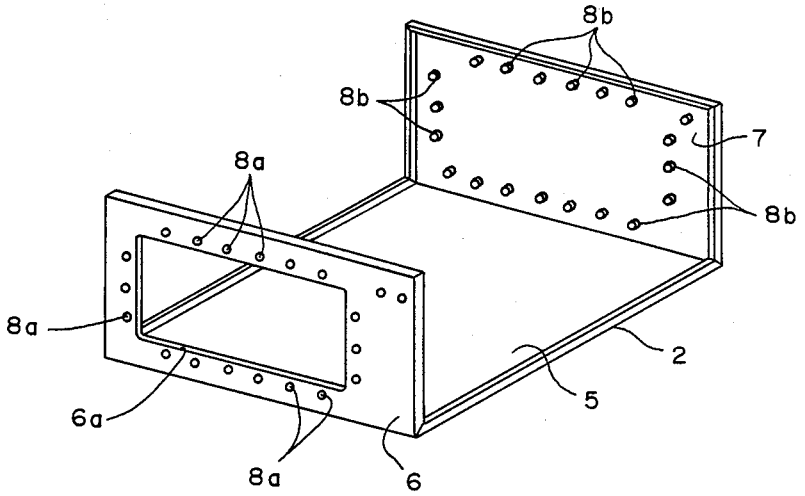
Figure 4A:
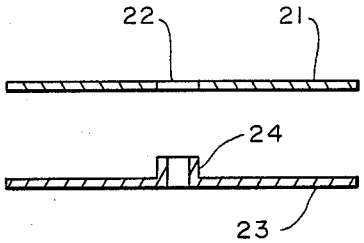
(PRIOR ART) FIG.—4A
FIGS. 4A, 4B, 4C and 5 show a conventional method of joining component plates for constructing an oven cavity housing.
Figure 4B:
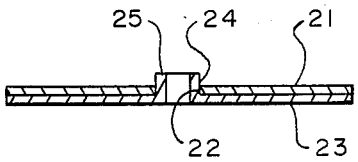
(PRIOR ART) FIG.—4B
Figure 4C:
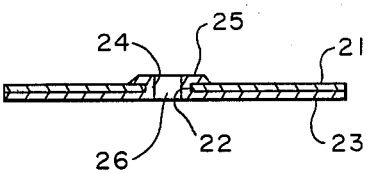
(PRIOR ART) FIG.—4C
Figure 5:
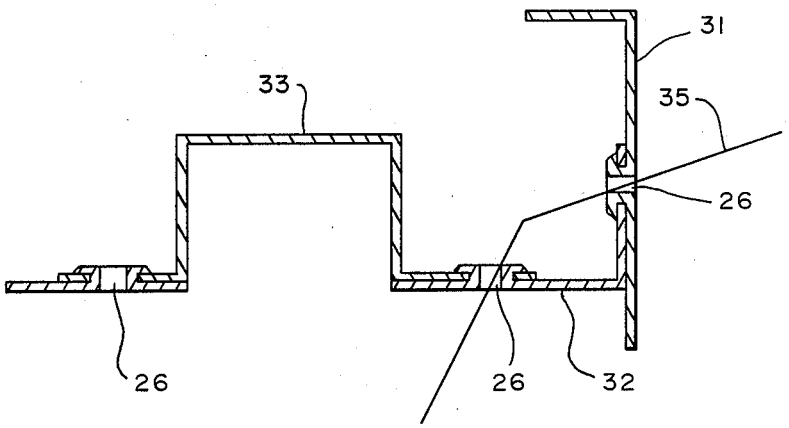
(PRIOR ART) FIG.—5

With reference to FIGS. 1 and 2, an oven cavity housing 1 embodying the present invention comprises a U-shaped outer frame 2 and a tubular inner frame 3 embracingly joined together to form a hollow chamber. A box-shaped body 4 serving as a wave guide is joined to the inner frame 3. The U-shaped outer frame 2 includes a base 5, a front wall 6 with a window **6*a* at the front and a back wall 7 at the back. The front and back walls 6, 7 are formed by bending upward perpendicularly with respect to the base 5** the same plate-like material which makes it.

Around the window **6*a* in the front wall 6, there are several tubular pieces 8*a* each with a closed end section protruding in the direction of the back wall 7. Likewise, the back wall 7 is provided with similar tubular pieces 8*b* each with a closed end section protruding in the direction of the front wall 6. These protruding pieces 8*a* and 8*b* on the front and back walls 6, 7** are provided at corresponding positions.

The inner frame 3 is formed in a tubular shape by folding a plate-like material. A left-hand wall 10 and a right-hand wall 11 are thus formed at the left-hand and right-hand edges of a base piece 9 and a ceiling 12 is connected at the top edges of the left-hand and right-hand walls 10, 11. The ceiling 12 includes an extended section **12*a* which protrudes to the right beyond the right-hand wall 11. The tubular inner frame 3 thus defines a front opening 13 and a back opening 14 respectively at the front and at the back as shown in FIG. 2B. There are a front flange 13*a* and a back flange 14*a* formed respectively around the front and the back openings 13 and 14. These flanges 13*a* and 14*a* are provided with holes 15*a* and 15*b*, respectively, such that they will match the protruding pieces 8*a* and 8*b* on the front and back walls 6, 7 of the outer frame 2. The ceiling 12 is also provided with a first wave guide opening 16*a* and its extended section 12*a* is likewise provided with a second wave guide opening 16*b*. Around these wave guide openings 16*a* and 16*b* the ceiling 12 and its extended section 12*a* are further provided with tubular pieces 8*c*** with closed top sections protruding in the upward direction.

The bottom surface of the box-shaped body 4 is open. A flange **4*a* is provided to this body 4 as shown in FIG. 2A with holes 15*c* matching the positions of the upwardly protruding pieces 8*c* on the ceiling 12 and its extended section 12*a*. FIG. 1 is a view when the components individually illustrated in FIG. 2** have been joined.

Figure 3A:
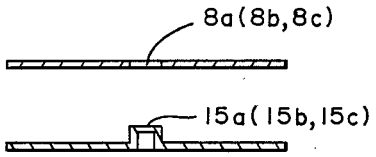
FIGS. 3A, 3B and 3C are cross-sectional views for showing a method of joining component plates according to the present invention.
Figure 3B:
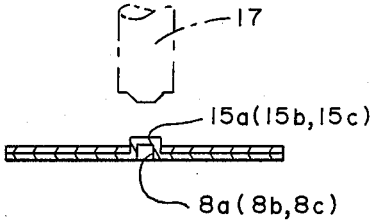
Figure 3C:
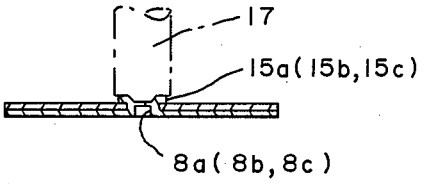

A process for joining these components by means of protruding pieces is explained next by making reference to FIG. 3. Firstly, the protruding pieces **8*a*, 8*b* and 8*c* on the outer and inner frames 2, 3 are inserted through the corresponding holes 15*a*, 15*b* and 15*c* prepared in the frames 2, 3 as well as in the box-shaped body 4. The closed top ends of these pieces 8*a*, 8*b* and 8*c* are crushed by a jig 17 so as to join the frames 2, 3 together and the body 4** without leaving any openings at the joints.

The foregoing description of a preferred embodiment of the invention has been presented for purposes of illustration and description. It is not intended to be exhaustive or to limit the invention to the precise form disclosed, and obviously many modifications and variations are possible in light of the above teaching. For example, the components illustrated above may be joined by providing protruding pieces on their flanges and holes at matching positions on the frames. In short, protruding pieces for joining components according to this invention have closed top ends so that there result no undesirable openings after their closed top ends are crushed.

What is claimed is:

1. An oven cavity housing comprising a first frame structure made from a sheet material which is bent to define a top, a bottom and two side walls, and a second frame structure made from a sheet material which defines a front, a bottom and a rear wall, either of said frame structures having thereon a plurality of tubular protruding pieces each with a closed end, the other of said frame structure having therein a plurality of holes at positions corresponding to said protruding pieces, said pieces being inserted through said holes and said closed ends being crushed such that said first and second frame structures form an integrally connected housing.

2. The oven cavity housing of claim 1 wherein said frame structures are assembled together such that said second frame structure embraces said first frame structure inside.

3. The oven cavity housing of claim 1 wherein said first frame structure further includes flange sections provided with protruding pieces or holes.

4. The oven cavity housing of claim 1 further comprising a box-shaped waveguide joined to said first frame structure.

* * * * *